US005704529A

United States Patent [19]

Santoro et al.

[11] Patent Number: 5,704,529

[45] Date of Patent: Jan. 6, 1998

[54] BACKPACK PORTFOLIO FOR ARTISTS

[76] Inventors: Michael Santoro, 27 Pierrepont St. Suite 2F, Brooklyn, N.Y. 11201; Paul J. Snyder, 475 Dean St. #3C, Brooklyn, N.Y. 11217

[21] Appl. No.: 647,338

[22] Filed: May 9, 1996

[51] Int. Cl.[6] ..... A45F 4/02

[52] U.S. Cl. ..... 224/629; 224/645; 224/653; 224/242

[58] Field of Search ..... 224/627, 629, 224/637, 645, 653, 242, 586

[56] References Cited

U.S. PATENT DOCUMENTS

| | | | |
|---|---|---|---|
| 518,270 | 4/1894 | Orth | 224/629 X |
| 2,324,194 | 7/1943 | Campiglia | 224/637 X |
| 2,836,334 | 5/1958 | Davis | 244/153 |
| 3,912,138 | 10/1975 | Pava | 244/154 |
| 4,061,224 | 12/1977 | Fuhri | 206/1.7 |
| 4,088,252 | 5/1978 | Grunberger | 224/629 |
| 4,213,520 | 7/1980 | Sarna et al. | 248/461 |
| 4,294,348 | 10/1981 | Hastings | 206/1.7 |
| 4,420,103 | 12/1983 | Douglas | 224/210 |
| 4,809,892 | 3/1989 | Chinaki et al. | 206/1.7 |
| 4,852,725 | 8/1989 | Folsom | 206/1.7 |
| 5,012,964 | 5/1991 | Falletta et al. | 224/629 X |
| 5,351,928 | 10/1994 | Cooper et al. | 248/461 |

*Primary Examiner*—Renee S. Luebke
*Attorney, Agent, or Firm*—Michael Ebert

[57] ABSTRACT

An artist portfolio that is worn as a backpack that includes a first storage compartment of rectilinear shape whose long axis is in the vertical plane. A plurality of webbing structures are affixed about the first compartment producing webbing loops for securing articles to the exterior of the compartment. A closure mechanism, such as a zipper, partially detaches the top lid of the first compartment permitting unobstructed access to the interior. The first compartment further includes a plurality of shoulder, anchor and waist straps for securing the portfolio to the upper body of the wearer. A second storage compartment of a predetermined shape is provided for housing additional articles. A plurality of upper cord lengths, locks, sleeves and eyelets are affixed at points as to allow the second compartment to be expanded and compressed about a predetermined volume. A plurality of closure mechanisms, such as zippers, permit unobstructed access to the interior of the second compartment. A plurality of third storage compartments of a predetermined shape is provided to house other articles. A plurality of lower cord lengths, locks, sleeves and eyelets are affixed at points as to allow the third compartments to be expanded and compressed about a predetermined volume. A plurality of closure mechanisms, such as zippers, permit access to the interior of the compartments as well as the plurality of retainer cords located inside.

19 Claims, 9 Drawing Sheets

BACKPACK PORTFOLIO FOR ARTISTS

BACKGROUND—FIELD OF INVENTION

This invention relates to an artist's portfolio and in particular to an artist's portfolio which is transported as a backpack.

BACKGROUND—DESCRIPTION OF PRIOR ART

Many artists, particularly art students must travel back and forth to class and to on-site locations on a regular basis. The majority of art students attend many different types of classes during a single semester. They are required to carry a broad range of artists' materials and supplies with them each day. These materials and supplies may include: multiple pads of paper, oversized drawings, canvases, plastic supply boxes, paints, rulers, T-squares, computer graphic and photographic supplies, transport tubes, three-dimensional modeling and sculpting materials, studio clothing, books and food. At the present time, there exists no single assembly specifically designed for carrying such materials and supplies.

Conventional artist's portfolios, as in U.S. Pat. No. 5,351,928 to Cooper et al (1994), typically include a single storage area for pads of paper, illustration boards, or a canvas and must be carried by hand as a suitcase. A disadvantage of such prior art portfolios is that they are cumbersome to carry and have very limited storage and transportation capabilities for the artist. Furthermore, because they are only capable of storing and carrying a very limited number of supplies and must be carried by hand, any additional art supplies must be stored in additional carrying devices. Many of these additional devices must also be carried by hand, making the transportation of artist materials awkward and dangerous, especially in crowded urban environments were many art schools are located.

Another disadvantage of such prior art portfolios is that they cannot be carried safely while riding a bicycle, or operating a motorcycle. They are also inconvenient and uncomfortable to take on subways, commuter railroads or buses, which are systems of transportation often used by art students to attend class and by artists to travel to on-site locations. Moreover, such hand-held prior art portfolios are encumbered by the adverse effects of weather such as wind and rain.

One alternative to the conventional artist portfolio was proposed in U.S. Pat. No. 4,809,892 to Chinaki (1989), in which an artist kit, including easel, bench, and storage compartment is carried as a backpack. A disadvantage of this prior art assembly is that it specifically addresses the needs of the painter. It does not provide the structure to store and carry artists' materials and supplies that someone who is practicing a wide variety of artistic disciplines would require. These additional supplies and materials for which there are no provisions for in the aforementioned assembly may include: large, multiple pads of paper, oversized drawings, plastic supply boxes, rulers and T-squares, computer graphic supplies, photographic supplies, transport tubes, three-dimensional modeling and sculpting supplies, studio clothing, books, and food.

Another disadvantage is that the structural nature of this prior art assembly does not permit the user to withdraw certain components and still have the remaining parts function as a backpack. Since easels and stools are components provided by most art schools, an art student who chooses to use this assembly, and retain the functionality of the backpack, must unnecessarily be encumbered by the weight and bulk of the easel and bench to use the limited storage compartment provided.

Moreover, because of the high number of different materials and manufacturing processes involved, this prior art assembly can be complicated and expensive for many artists and art students. Although the prior art assembly provides a cover for the storage compartment, no provision is made for protecting the assembly and artwork from adverse weather such as rain and snow. This disadvantage limits the usefulness of the prior art assembly and increases the possibility of damage to the artwork.

Another approach to carrying materials and supplies is found in U.S. Pat. No. 4,420,103 to Douglas (1983), in which an integral frame backpack was proposed. This prior art assembly provides the user with the ability to carry general supplies and equipment usually associated with camping and sporting goods. A disadvantage of such prior art assembly is that they lack the appropriate structure to carry most supplies and materials associated with making art. Such prior art backpacks make no structural provisions for carrying large, multiple pads of paper, canvases, oversized drawings and finished artwork. These items must be carried in a conventional, hand-held artist's portfolio subjecting them to the aforementioned problems and limitations or carried loosely subjecting them to the possibility of damage. Finally, the internal structure of such prior art assemblies will not allow precise adjustments of the volume of the storage compartment to the volume of the article or articles being carried.

OBJECTS AND ADVANTAGES

Accordingly, several objects and advantages of the invention are:

(a) to provide an artist portfolio that is worn as a backpack whereby an artist or art student can carry all the supplies and materials needed to attend a broad range of art classes;

(b) to provide the ability to carry all the supplies and materials needed to work in a broad range of artistic mediums to an on site-location;

(c) to provide an artist portfolio that is worn as a backpack that can carry other storage devices designed for art supplies such as plastic supply boxes, transport tubes, and the like.

(d) to provide an artist portfolio that is worn as a backpack which allows the user to safely and securely ride a bicycle or operate a motorcycle, and to comfortably and conveniently use public transportation such as subways, commuter railroads, bus services and the like;

(e) to provide an artist portfolio that is worn as a backpack that protects the contents from, and is not encumbered by the adverse effects of weather such as rain, snow, and wind.

(f) to provide an artist portfolio that is worn as a backpack that through its structure enables the invention to always function as a backpack; is simple to own, operate and maintain; and that through the use of simple materials and manufacturing processes can be afforded by most artists and art students.

(g) to provide an artist portfolio that is worn as a backpack that can carry large, multiple pads of paper, canvases, oversized drawings, and finished artwork along with three-dimensional modeling and sculpting materials such as clay, plaster, foam, wood and the like;

(h) to provide an artist portfolio that is worn as a backpack that can carry additional supplies and materials such as computer graphics supplies, photographic supplies, clothing for studio work, books and food.

Further objects and advantages of the invention are to provide an artist portfolio that is worn as a backpack whose structure enables the user to carry a broad range of supplies and materials associated with making many different types of art and whose structure features the ability to precisely adjust the volume of the storage compartment to the volume of the article or articles being carried.

Briefly stated, these objects are accomplished in a portfolio in accordance with the invention that is wearable as a backpack for transporting a load of articles in various sizes useable by an artist, including large drawing paper pads. The portfolio includes a generally-rectangular top-loaded first compartment having front and rear walls for accommodating the larger articles in the load. Shoulder and waist straps are attached to the rear wall of the first compartment for mounting the portfolio on the back of the wearer. Attached to the front wall of the first compartment is a second compartment flanked on either side by third compartments, the second and third compartments being expansible to accommodate the remainder of the load.

Other objects, features and advantages of the invention will become apparent from a consideration of the following drawings and detailed description.

DRAWING FIGURES

DETAILED DESCRIPTION—FIGS. 1 to 8

Figure 1:
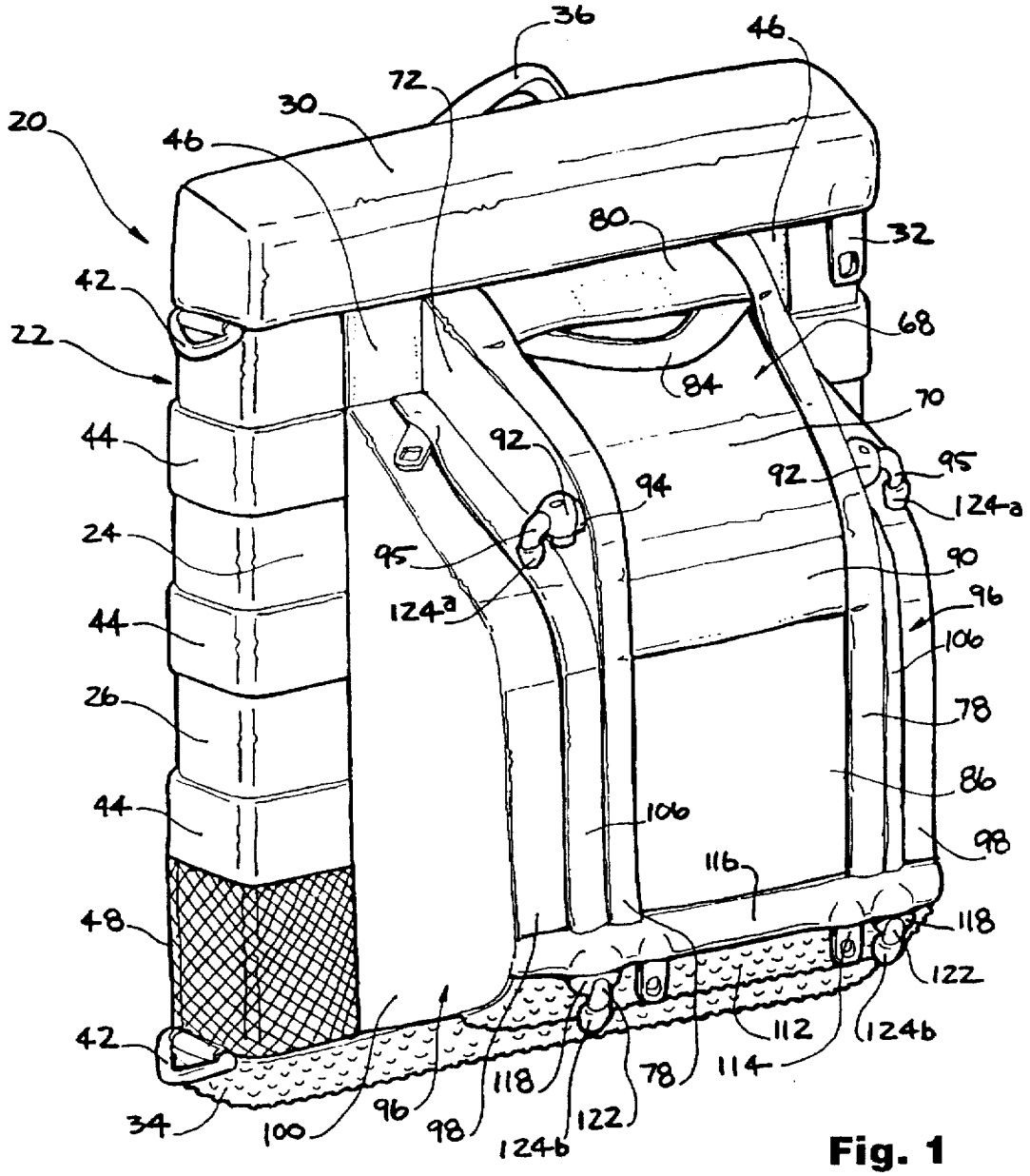
FIG. 1 is a front perspective view of a backpack portfolio for artists expanded to maximum capacity, and incorporating the presently preferred embodiment of the invention.
Figure 2:
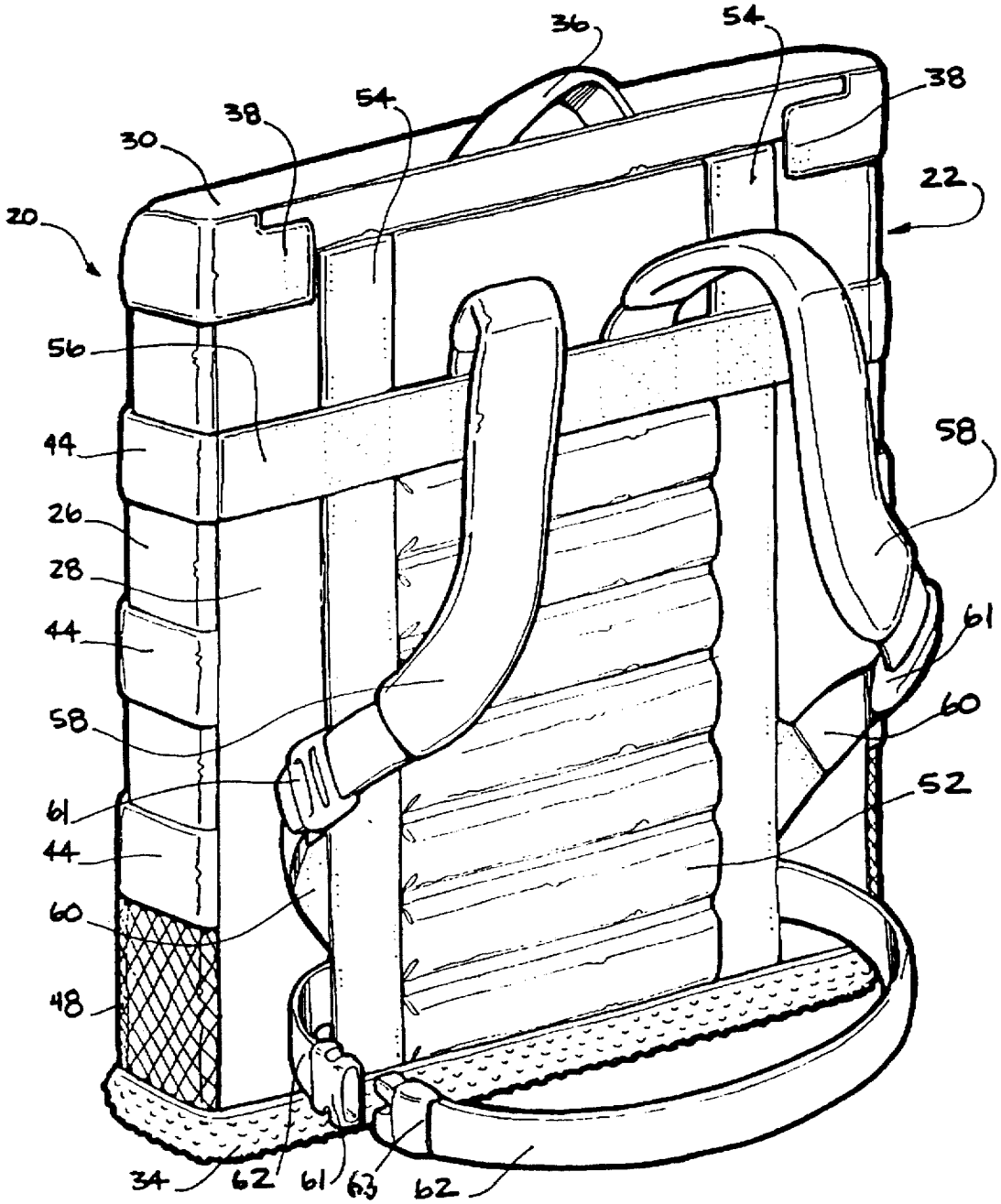
FIG. 2 is a rear perspective view of a backpack portfolio for artists incorporating the presently preferred embodiment of the invention.
Figure 3:
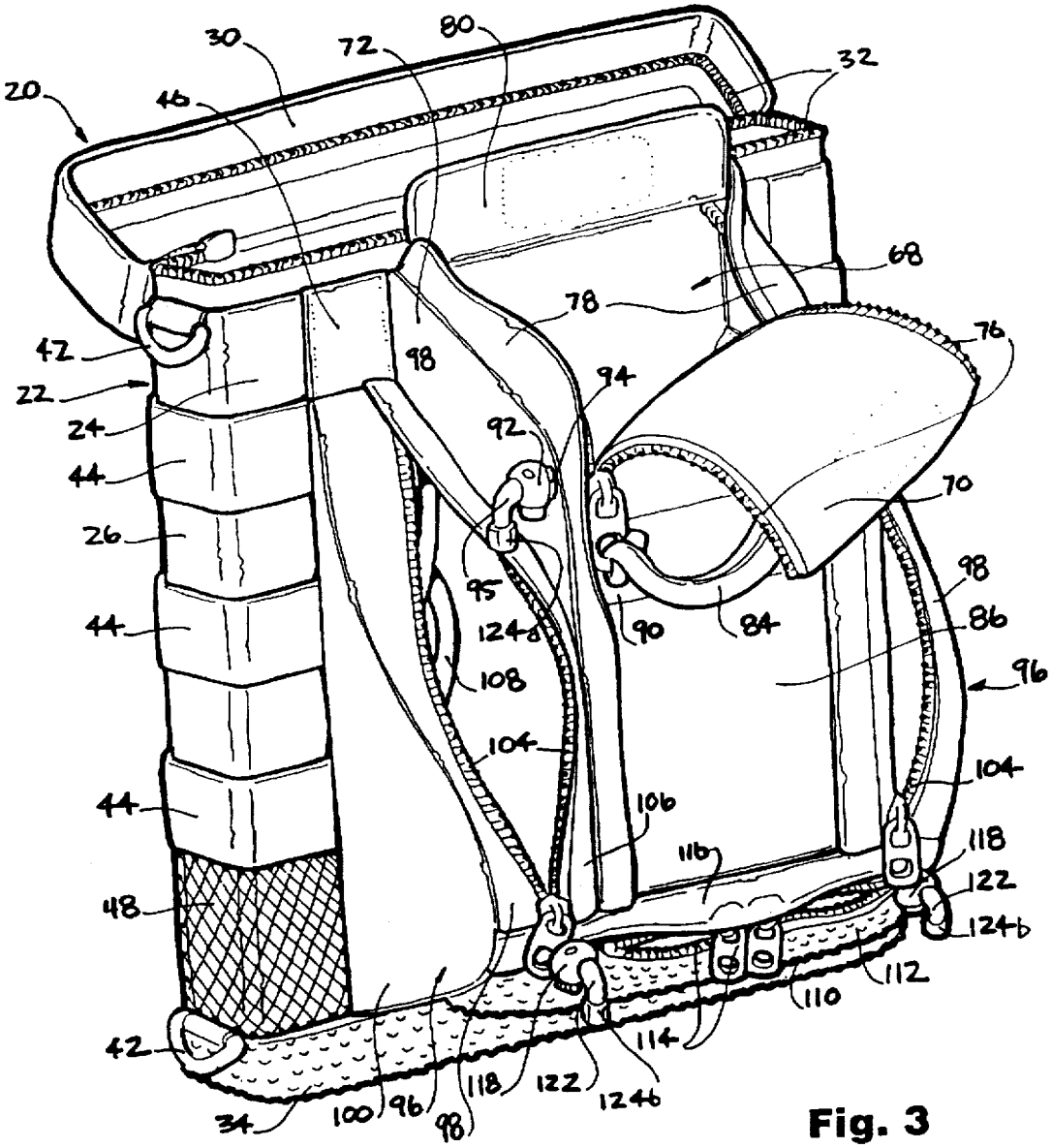
FIG. 3 is a front perspective view of a backpack portfolio for artists with its storage compartments open.
Figure 5:
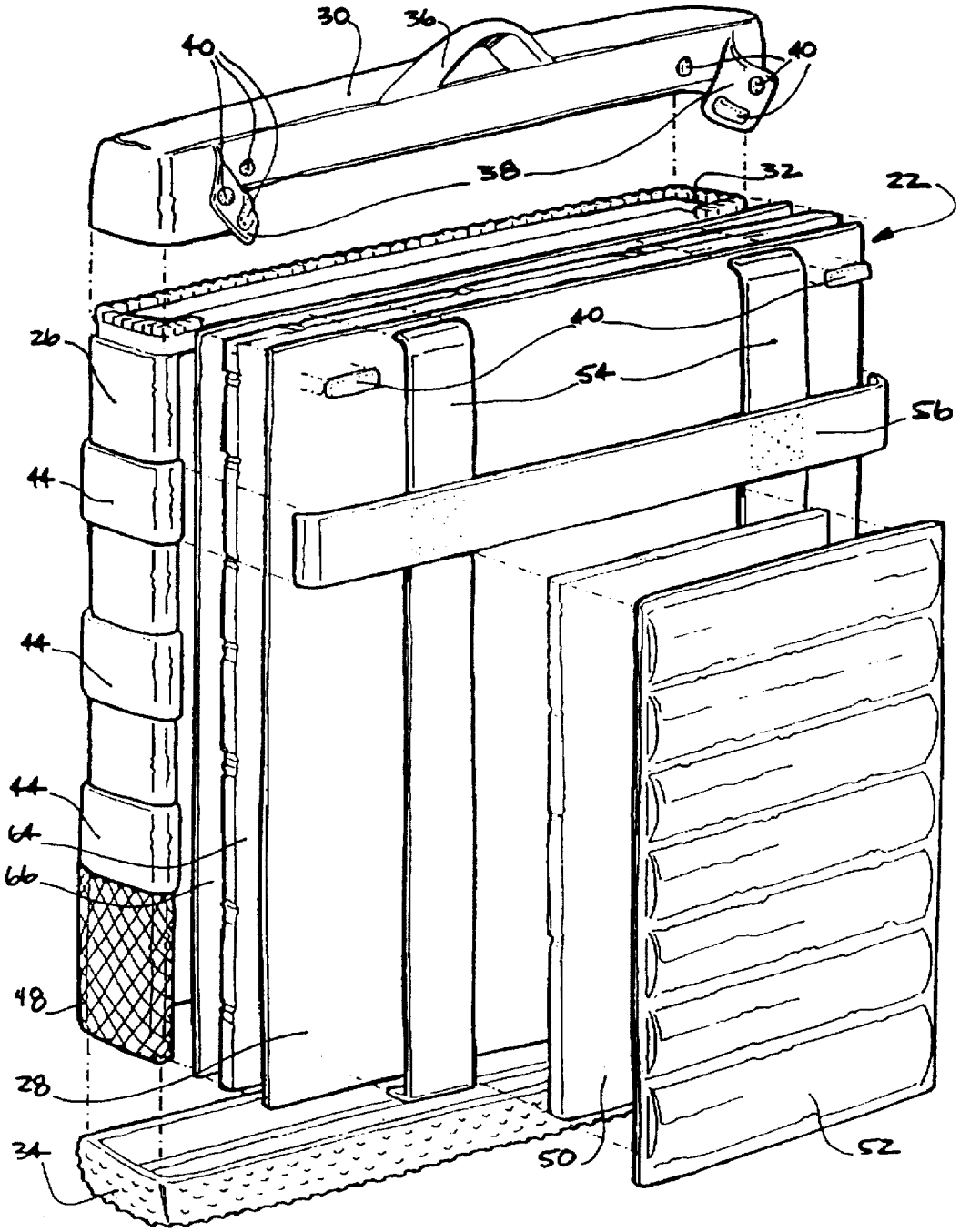
FIG. 5 is an exploded rear perspective view of the structural assembly of the first storage compartment with the shoulder, anchor, and waist straps omitted for clarity.

A typical embodiment of the present invention is illustrated in FIG. 1 (perspective front view) and FIG. 2 (perspective rear view), showing a backpack portfolio 20 for artists. The portfolio includes a first storage compartment 22, having a front wall 24, a plurality of side walls 26, a rear wall 28, a top lid 30, a closure mechanism 32, and a bottom panel 34. Top lid 30 is fastened to the perimeter seam of rear wall 28 and may include a lifting loop 36. FIG. 5 (exploded rear view) illustrates a plurality of tabs 38 incorporated into top lid 30. A plurality of fasteners 40 are affixed to the inside surface of tabs 38 and to their corresponding position on rear wall 28. As best seen in FIG. 3 (perspective front view with storage compartments open), a closure mechanism 32 is vertically attached to the inside surface of top lid 30 and to the corresponding compartment walls which allows the lid to swing back when opened. A plurality of attachment rings 42 may be affixed to the upper and lower horizontal seams of side walls 26 as shown in the preferred embodiment.

Figure 4:
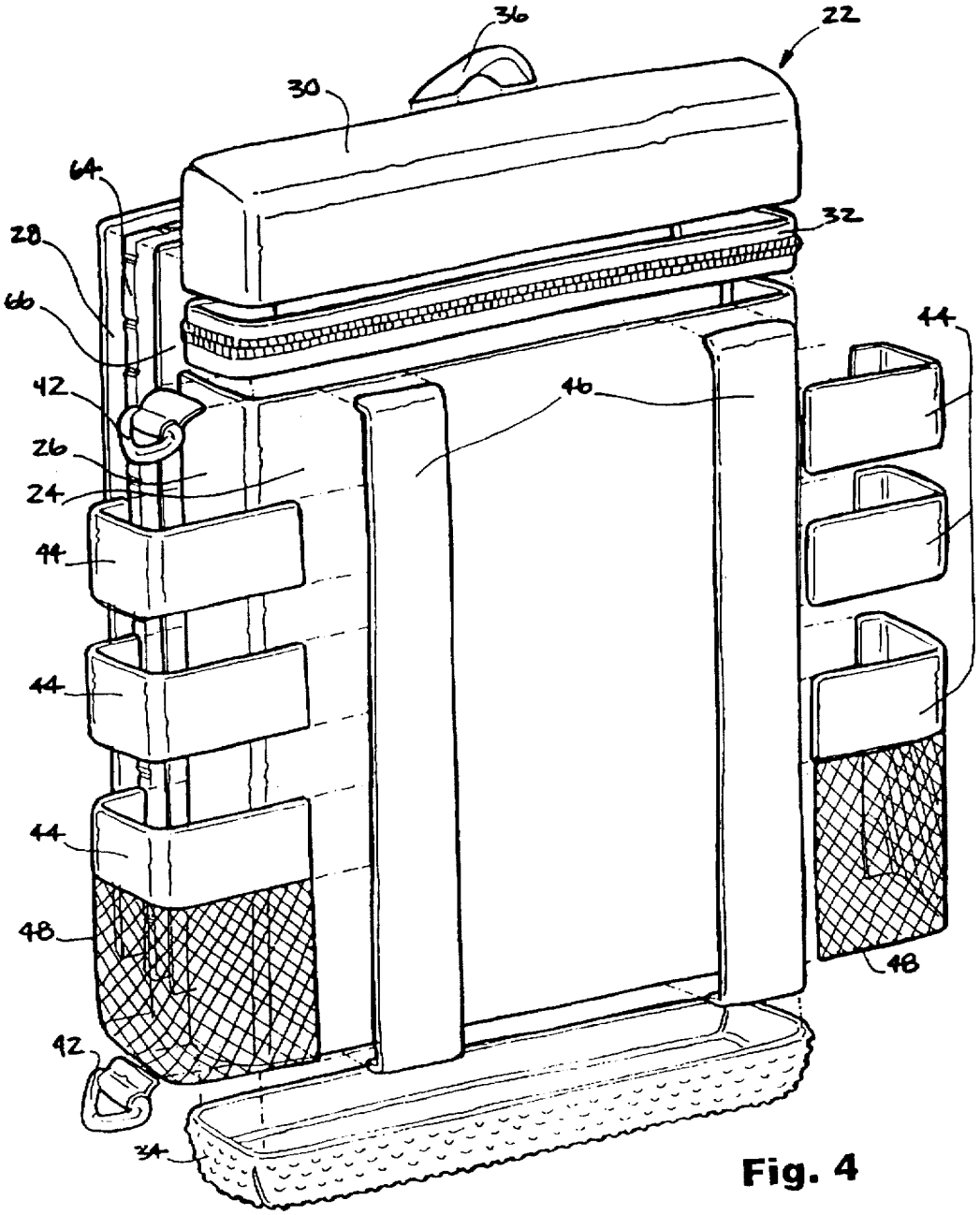
FIG. 4 is an exploded front perspective view of the structural assembly of the first storage compartment.

As seen in FIGS. 2, 4 (exploded front view) and 5, a plurality of front horizontal webbing members 44 are attached to front wall 24. This occurs at the point of overlap with a plurality of front vertical webbing members 46. They are attached at the seam of rear wall 28 and side walls 26 creating a plurality of loops that wrap around compartment 22. A plurality of mesh pockets 48 are formed by affixing the top edge of the mesh panel to the lowest placed horizontal webbing member. The lowest edge of the mesh panel is affixed at the seam of front wall 24, side wall 26, and bottom panel 34. The vertical edges of the mesh panel are affixed in front at the point of overlap with webbing members 46 and in the rear at the seam of rear wall 28 and side walls 26.

External padding 50 and a padding cover 52 are affixed to rear wall 28. This occurs at the point of overlap with a plurality of rear vertical webbing members 54 and a rear horizontal webbing member 56. The lower edge is affixed at the seam of rear wall 28 and bottom panel 34. The portfolio also includes: a plurality of padded adjustable shoulder straps 58 affixed at webbing member 56; a plurality of anchor straps 60 affixed along webbing members 54; and an adjustable waist strap 62 with a waist buckle 63 affixed along the same webbing members. Straps 58 are joined to straps 60 by a plurality of buckles 61.

FIG. 5 illustrates a stiffener panel 64 between rear wall 28 and rear inner wall 66 of compartment 22. Stiffener panel 64 is slightly narrower and shorter than rear wall 28. Inner wall 66 is affixed to rear wall 28 along the perimeter seam, trapping stiffener panel 64 as in a sealed pocket.

As best seen in FIGS. 1, 3 (front perspective view with compartments open), 6 (exploded view of second compartment), portfolio 20 also includes a second storage compartment 68 having a main wall 70, a plurality of side wails 72, a floor panel 74 and a plurality of closure mechanisms 76. Compartment 68 is affixed to front wall 24 of compartment 22 along the inner edges of webbing members 46. Side walls 72 project perpendicularly from front wall 24 and are joined to main wall 70 by closure mechanisms 76. A plurality of closure covers 78, which consist of folded sections of fabric, are affixed to the outer seam of closure mechanisms 76. A cover flap 80 is affixed to the seam of front wall 24 and closure mechanism 32 of compartment 22. A fastener 82 may be affixed to the underside of cover flap 80 and to its corresponding position on main wall 70. A closure tie 84 may be utilized, for example, to link closure mechanisms 76 of compartment 68. An upper storage pocket 86 with a fastener 88 and a pocket flap 90 may be integrally formed with the outside vertical surface of main wall 70. A floor panel 74 is affixed to front wall 24 and the inside surfaces of side walls 72 and main wall 70. A plurality of upper sleeves 93 are affixed to the inside of side walls 72 and guides a plurality of upper adjustment cords 95 to a plurality of upper eyelets 94 where cords 95 exit through a plurality of upper cord locks 92 and become visible. Cords 95 are affixed between front wall 24 and webbing structures 46. Cords 95 may include a plurality of cord ends **124*a*** as shown in the preferred embodiment.

Figure 7:
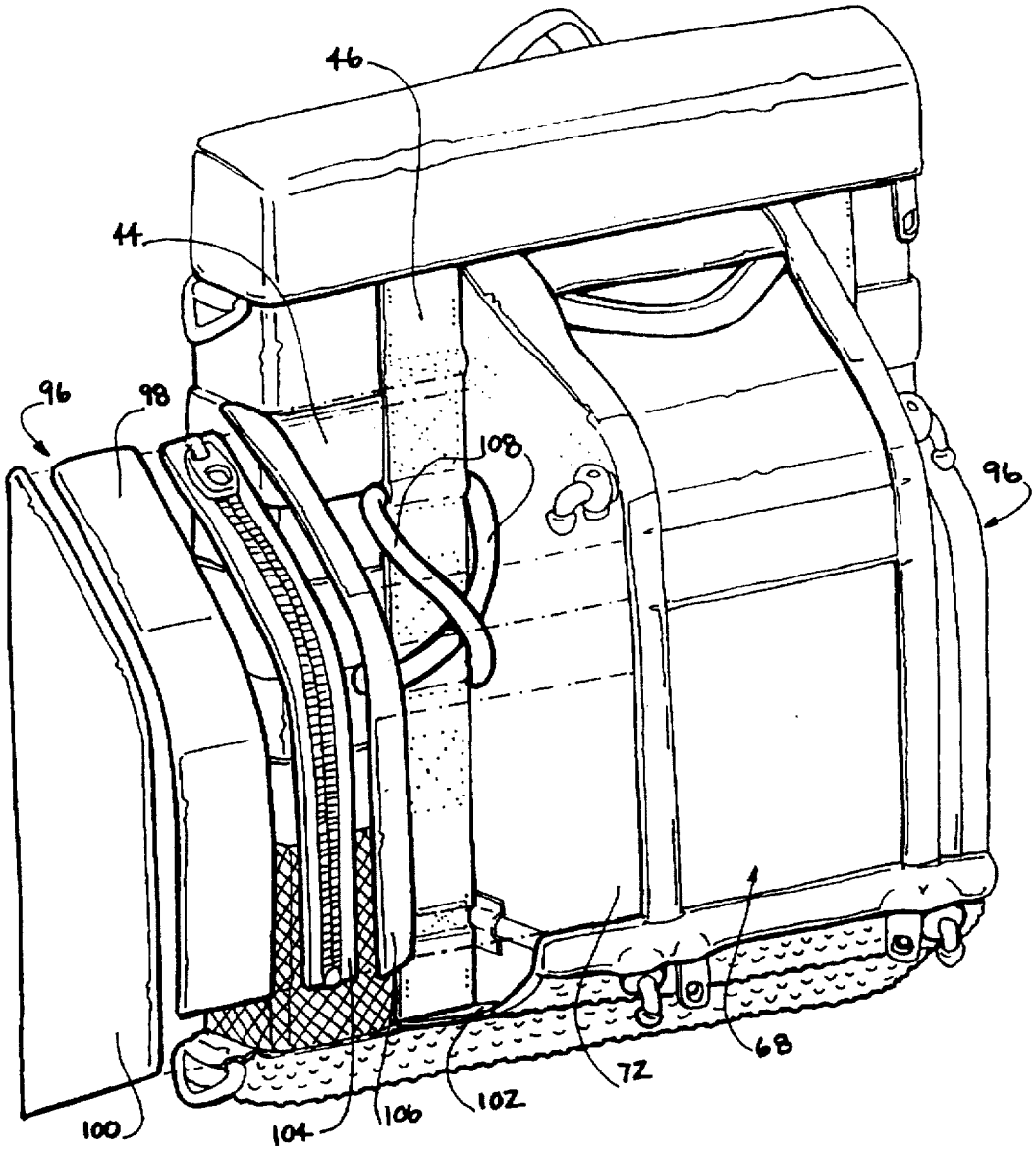
FIG. 7 is an exploded view of the structural assembly of a third storage compartment.

Additionally, FIGS. 1 and 3 shows that portfolio 20 includes a plurality of third storage compartments 96. As shown in FIG. 7 (exploded view of a third compartment), for example, compartment 96 is comprised of an angled wall 98, an outer side wall 100, a bottom panel 102, and a closure mechanism 104. Compartment 96 is affixed to front wall 24 along the outer edges of webbing members 46. Outer side wall 100 projects perpendicularly from front wall 24 and is joined to angled wall 98 and to bottom panel 102. Angled wall 98 is joined to side wall 72 of compartment 68 by closure mechanisms 104. A closure cover 106, which consists of a folded section of fabric, is affixed to the seam of closure mechanism 104 and compartment 68. A plurality of retainer cords 108 may be located inside one or more of compartments 96. Cords 108 are affixed to webbing members 46.

Figure 8:
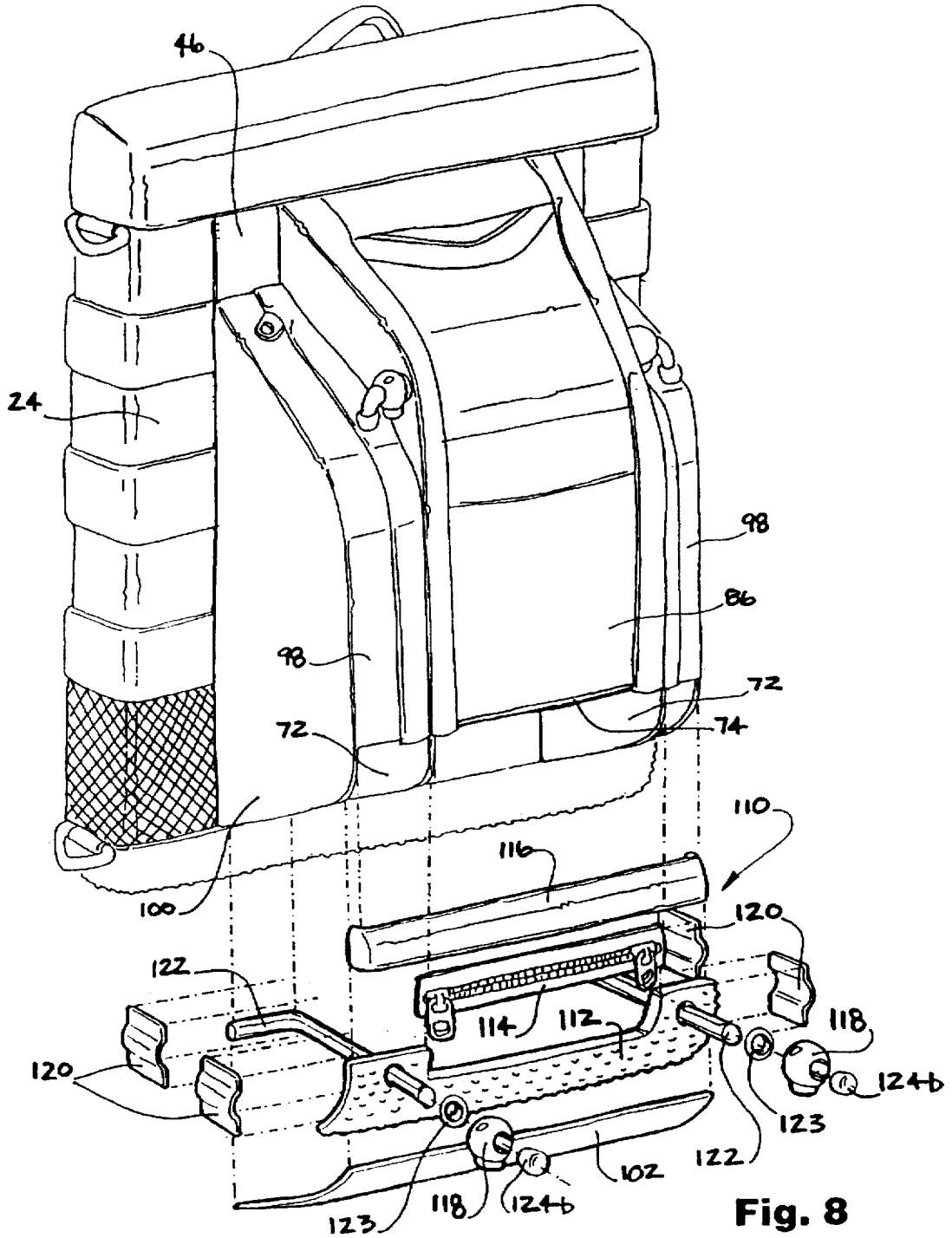
FIG. 8 is an exploded view of the structural assembly of a lower storage pocket.

As best seen in FIGS. 1, 3, and 8 (exploded view of lower pocket and internal cord structures), portfolio 20 may also include a lower storage pocket 110 having a front textured panel 112, and a closure mechanism 114. Pocket 110 is formed by floor panel 74 and side walls 72 of compartment 68 and bottom panel 102 of compartments 96. A closure mechanism 114 is incorporated into panel 112 providing access to pocket 110. A closure cover 116, which consists of folded section of fabric, may be affixed to the outer seam of closure mechanisms 114 as shown in the preferred embodiment. A plurality of lower sleeves 120 are affixed to the outside of side walls 72 and guides a plurality of lower adjustment cords 122 to a plurality of lower eyelets 123 in panel 112. Here, cords 122 exit through a plurality of lower cord locks 118 and become visible. Cords 122 are affixed between front wall 24 and webbing structures 46. These cords may include cord ends 124b as shown in the preferred embodiment.

Operation—FIGS. 1 to 9

The manner of using back portfolio 20 is similar to that for most backpack assemblies. As shown in FIGS. 2, 3 and 5, to load compartment 22 one would first peel tabs 38 of top lid 30 away from fasteners 40 on rear wall 28 to gain access to closure mechanism 32. Unzip closure mechanism 32 or other suitable fastening assembly, and lift top lid 30 back and away. This unveils an unobstructed opening to the interior of compartment 22. One can now place large, multiple pads of paper, illustration boards, oversized drawings, canvases, and the like, inside the compartment. To reseal, one flips top lid 30 forward and rezips closure mechanism 32. Then, making sure the closure mechanism is completely concealed by top lid 30, pulls tabs 38 around compartment 22 to rear wall 28 and reattaches them to fasteners 40. This creates a seal around the top of compartment 22 protecting the contents from adverse weather such as rain and snow. Fastener 40 can be a hook and loop patch, a snap fitting or any suitable fastening assembly. Compartment 22 may also include a textured, bottom panel 34 as shown in the preferred embodiment. Panel 34 provides durability to a high-wear area of the portfolio.

Should the portfolio become wet, lifting loop 36 can be used for hang drying. Loop 36 may also be used to carry the portfolio short distances in the upright position. Attachment rings 42 are optionally provided and can be used to secure a transport tube to the portfolio. This can be accomplished by threading the straps of the tube through rings 42 and tightening.

As seen in FIG. 1, webbing members 44 and mesh pockets 48 are provided to carry a multiple amount of rulers, T-squares, large brushes, and the like. Starting at the top, these articles are slid through webbing members 44 into pockets 48, where they are securely held. To remove, one holds the article from the top and pulls up, sliding the articles out of pockets 48 and through the loops. The webbing members 46 provide points of attachment for compartments 68 and 96, and components 108 and 122.

As best shown in FIG. 2 and 5, external padding 50 and padding cover 52 provide the user with a comfortable surface on which to rest their back. Horizontal rows of stitching are used to create channels for air to pass through and provide ventilation. Padding 50 can be an open or closed cell material of different densities.

As seen in FIG. 2, padded adjustable shoulder straps 58 work together with anchor straps 60 to provide a comfortable and adjustable system for carrying the portfolio. One slips arms through straps 58, which are joined to straps 60 and adjusts buckles 61 to fit. Waist strap 62 and waist buckle 63 provide additional control and security by holding the lower sections of the portfolio tightly against the user's body. This is an important function especially for users who carry wear the portfolio while riding a bicycle or operating a motorcycle. Webbing members 54, and 56 provide attachment points for the abovementioned straps.

As best seen in FIG. 5, stiffener panel 64 provides structure to hold the portfolio upright while loading and unloading and keeps the artwork and materials inside from being damaged. Inner wall 66 creates a pocket for stiffener panel 64 and provides a smooth surface in which to slide materials in and out of compartment 22. Stiffener panel 64 is a thin high density material having a slight amount of flexibility and can be a polystyrene or a polyvinyl chloride like plastic.

As seen in FIGS. 1 and 3, to load second compartment 68, one first peels cover flap 80 up and away from fastener 82 on main wall 70. Pulling on closure tie 84 simultaneously pulls back closure covers 78 and unzips closure mechanisms 76 or other suitable fastening assemblies. Main wall 70 will fall forward and away unveiling an unobstructed opening to the interior of compartment 68. One can now place plastic supply boxes, finished artwork, studio clothing, three-dimensional modeling and sculpting materials such as clay, plaster, foam, wood, and the like, inside. To close compartment 68, pull closure tie 84 back up to rezip closure mechanisms 76. Fold closure covers 78 down over closure mechanisms 76 to protect the contents from adverse weather such as rain and snow. Refasten cover flap 80 to main wall 70, further protecting the contents from adverse weather. Fastener 82 can be a hook and loop patch, a snap fitting, or any other suitable fastening assembly.

Figure 6:
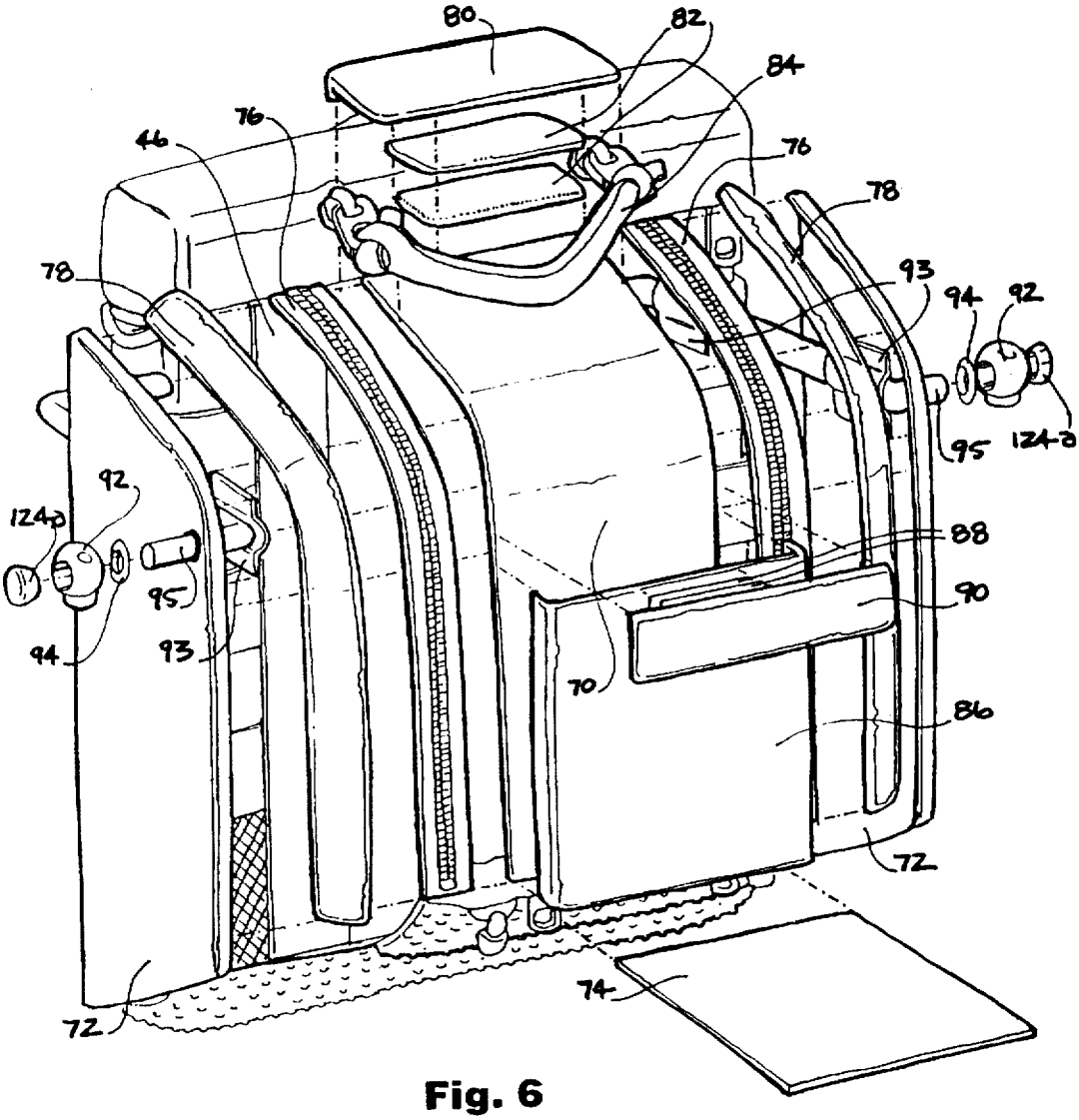
FIG. 6 is an exploded view of the structural assembly of the second storage compartment with plurality of third compartments omitted for clarity.
Figure 9:
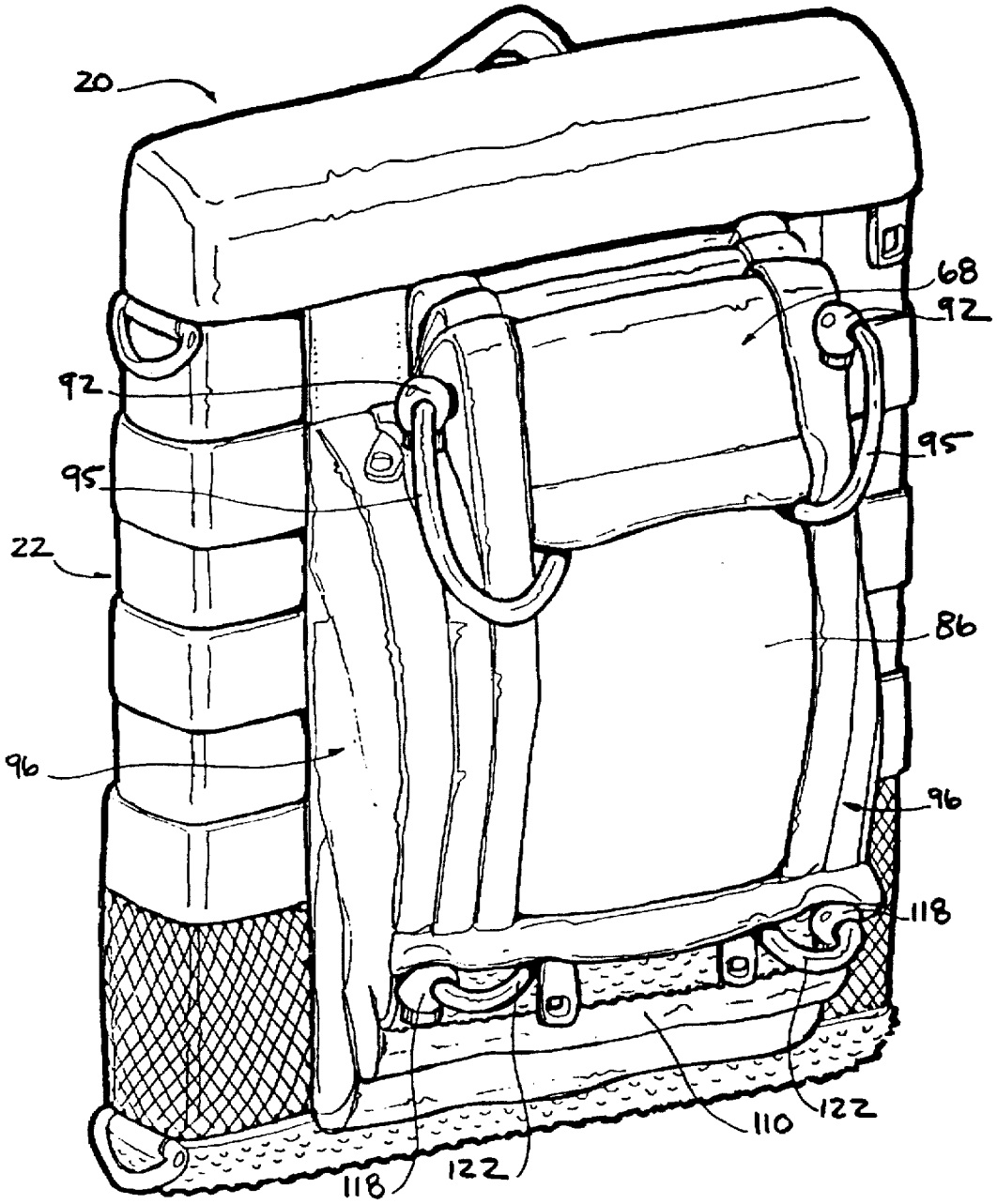
FIG. 9 is a front perspective view of a backpack portfolio for artists adjusted to minimum capacity.

As best seen in FIGS. 6 and 9 (front perspective view at minimum capacity), upper cord locks 92, sleeves 93, eyelets 94, and cords 95, are incorporated into compartment 68. These items allow one to accurately adjust the volume of compartments 68 to the size of the article or articles being carried. This is accomplished by first releasing locks 92 to allow cords 95 to pass through freely. By holding cords ends 124 and sliding locks 92 towards compartment 22, the upper sections of compartment 68 are compressed in an accordion-like fashion. Excess cording can be stored in pocket 86. To expand the internal storage, one releases locks 92 and slides them forward allowing cords 95 to be pulled back into eyelets 94. This will allow the compartment to expand to its' maximum capacity. Internal cord sleeves 93 help guide cords 95 and prevents them from binding against articles inside. Eyelets 94 and cord ends 124a prevent fraying of fabric and preserve a neat, clean appearance.

To use one of third compartments 96, one unzips closure mechanism 104 or other suitable fastening assembly, simultaneously pulling back closure cover 106. Gaining access to the interior, one can now place transport tubes, large jars of paint, cans of spray paint, and the like through retainer cords 108 which will secure the articles to the structure of portfolio 20. Other materials and supplies that can be carried in compartment 96 include computer graphics supplies, photographic equipment, books and food. To reseal compartment 96, one rezips closure mechanism 104 and folds the closure cover 106 down to protect the contents from adverse weather.

Additionally, to make use of lower pocket 110, one unzips closure mechanism 114 or other suitable fastening assembly simultaneously peeling back closure cover 116. To close pocket 110, one rezips closure mechanism 114 and folds the closure cover 116 down over closure mechanism 114 to protect the contents from adverse weather. Front textured panel 112 is provided to prevent premature wear in a high-wear area.

As best seen in FIGS. 8 and 9, cord locks 118, sleeves 120, cords 122, and eyelets 123, are incorporated into compartments 96. These items allow one to accurately adjust the volume of compartments 96 to the size of the article or articles being carried. This is accomplished by first releasing locks 118 to allow cords 122 to pass through freely. By holding cords ends 124 and sliding locks 118 towards compartment 22, the lower sections of compartments 96 are compressed in an accordion-like fashion. Excess cording can be stored in pocket 110. To expand the internal storage, one releases locks 118 and slides them forward allowing cords 122 to be pulled back into eyelets 123. This will allow the compartments to expand to their maximum capacity. Internal cord sleeves 120 help guide cords 122 and prevents them from binding against articles inside. Eyelet 123, and cord ends **124*b*** prevent fraying of fabric and preserve a neat, clean appearance.

Portfolio 20 may be constructed of any suitable imperforate material or combination of materials such as nylon, canvas or the like. The fabric may be coated with a weather or water repellent as desired. The textured panels shown in the preferred embodiment may be constructed of a treated nylon, canvas, leather or like material, or be a formed plastic part.

SUMMARY, RAMIFICATIONS AND SCOPE

Accordingly, the reader will see that the backpack portfolio for artists can be used to carry all the supplies and materials need to attend a broad range of art classes and to carry a broad range of artistic mediums to an on-site location. The reader will also see that the invention can carry other storage devices designed for art supplies and materials such as plastic supply boxes, transport tubes and the like. In addition, the user is now able to safely and securely ride a bicycle or operate a motorcycle and to comfortably and conveniently use public transportation. This is due to the centralized placement of the materials being carried and the hands-free nature of the backpack configuration provided by the invention. Moreover, the structure and use of materials will protect the contents from, and not be encumbered by adverse weather such as rain, snow and wind.

Furthermore, the portfolio, through it's integrated, complete structure will always function as a backpack, is easy to use and understand, and because of simple materials and construction can be afforded by most artists and art students. Additional advantages to the portfolio are that it will carry large, multiple pads of paper, canvases, oversized drawings, and finished artwork along with three-dimensional modeling and sculpting materials such as clay, plaster, foam, wood and the like. It will also carry additional supplies and materials such as computer graphics supplies, photographic supplies, clothing for studio work, books, and food. The portfolio also features the ability to precisely adjust the volume of the storage compartment to the volume of the article or articles being carried, preventing shifting and possible damage to the articles or to the artwork inside.

While this invention has been described as having a preferred design, it will be understood that it is capable of further modification. This application is therefore intended to cover any variations, uses, or adaptations of the invention following the general principles thereof. Thus, and by way of example and not of limitation, the number, size and shape of storage compartments and closure mechanisms and their orientation, both internal and external, may be varied from that which is detailed above. Accordingly, it is to be further understood that the detailed description and drawings set forth are for illustrative purposes only and should not be construed as limitations on the scope of the invention.

We claim:

1. A portfolio for artists that is worn as a backpack comprising:

(a) a first storage compartment comprising a front wall, a plurality of first side walls, a rear wall, a top lid, and a first bottom panel defining a rectangular storage space;

(b) structural means for removably securing an article or articles to the exterior of said first compartment;

(c) a first closure mechanism for partially detaching said top lid from said first compartment thereby permitting unobstructed access to the interior of said first compartment;

(d) a plurality of straps including shoulder, anchor, and waist straps attached to a plurality of webbing members joined to said rear wall;

(e) a second storage compartment comprising a main wall, a plurality of second side walls, and a floor panel, defining a predetermined storage space;

(f) adjustability means for expanding and compressing said second compartment;

(g) a plurality of second closure mechanisms for partially detaching said main wall from said second side walls thereby permitting unobstructed access to the interior of said second compartment;

(h) a plurality of third storage compartments comprising a plurality of angled walls, a plurality of outer side walls, and second bottom panels defining predetermined storage spaces, and retaining means for removably securing an article or articles to the interiors of said third compartments;

(i) adjustability means for compressing and expanding said third compartments; and (j) a plurality of third closure mechanisms which join said angled walls to said side walls wherein said closure mechanisms, when opened, provide access to the interior of said third compartments.

2. The portfolio of claim 1 wherein said first side walls have a width approximately one tenth to one fourteenth of the width of the front and rear walls.

3. A portfolio as set forth in claim 2, further including a vertical series of spaced webbing loops wrapped about each of said side walls of the first compartment adapted to hold additional articles.

4. A portfolio as set forth in claim 3, further including a mesh pocket wrapped about each of said side walls at a lower end thereof below the loops.

5. The portfolio in claim 1 wherein said structural means of said first compartment includes a plurality of webbing members affixed on said first compartment producing webbing loops, allowing articles to be passed through and secured.

6. The portfolio as set forth in claim 1, wherein said first closure mechanism for partially detaching said top lid from said compartment includes a zipper assembly having one set of teeth affixed to an inside surface of said top lid and another set of teeth affixed to an upper edge of said first compartment.

7. The portfolio in claim 1 wherein the adjustability means for expanding and compressing said second and third compartments includes a plurality of first cord lengths, sleeves, cord locks, and eyelets affixed at points as to allow said second and third compartments to expand and compress by a predetermined volume.

8. The portfolio in claim 1 wherein said plurality of second closure mechanisms for said second compartment include zipper assemblies having one set of teeth affixed to said main wall and another set of teeth affixed to said second side walls.

9. The portfolio in claim 1 further including a cover flap comprising a folded section of imperforate material affixed to said front wall of said first compartment incorporating a fastening assembly having one part of said assembly affixed to the underside of said flap and another part of said assembly affixed to the outer surface of said main wall.

10. The portfolio in claim 1 wherein said third closure mechanisms which join said angled walls to said second side walls include zipper assemblies having one set of teeth affixed to said angled walls and another set of teeth affixed to said second side walls of said second compartment.

11. The portfolio in claim 1 wherein said retaining means comprises a plurality of retainer cords capable of securing articles inside said third compartments.

12. The portfolio in claim 1 further including an upper storage pocket integrally formed with an outside surface of said second compartment.

13. The portfolio in claim 1 further including a lower storage pocket formed by said floor panel and said second side walls of said second compartment and said second bottom panels of said plurality of third compartments.

14. The portfolio in claim 13 further including a fourth closure mechanism having a zipper assembly comprising one set of teeth affixed to said floor panel and another set of teeth affixed to said second bottom panels allowing access to said lower pocket.

15. The portfolio in claim 1 further including a plurality of closure covers comprising folded sections of imperforate material affixed to seams of said second and third closure mechanisms.

16. A backpack portfolio, including in combination (a) a first compartment having a front wall, a plurality of first side walls, a rear wall, a top lid, and a first bottom panel defining a rectangular storage space having a short axis parallel to a shoulder plane of the wearer;

(b) a first closure mechanism for partially detaching said top lid from said first compartment thereby permitting complete access to the interior of said first compartment;

(c) a plurality of straps including shoulder, anchor and waist straps affixed to said rear wall;

(d) a plurality of webbing members affixed to said front wall as to create a plurality of webbing loops;

(e) a second compartment having a main wall, a plurality of second side walls, and a floor panel, defining a predetermined storage space;

(f) a plurality of first cord lengths affixed to said webbing members;

(g) a plurality of first sleeves affixed to said second side walls;

(h) a plurality of first eyelets affixed to said second side walls;

(i) a plurality of first cord locks securing a section of said first cord lengths at a predetermined position, with said first locks, eyelets, sleeves and cord lengths affixed at points as to allow said second compartment to expand and compress to a predetermined volume;

(j) a plurality of second closure mechanisms for partially detaching said main wall from said second side walls thereby permitting complete access to the interior of said second compartment;

(k) a plurality of third compartments having a plurality of angled walls, a plurality of outer side walls, and second bottom panels defining predetermined storage spaces;

(l) a plurality of retainer cords inside said third compartment;

(m) a plurality of third closure mechanisms joining said angled wall to said second side walls wherein said closure mechanisms, when opened, provides access to the interior of said third compartments;

(n) a plurality of second cord lengths;

(o) a plurality of second sleeves affixed to said second side walls;

(p) a plurality of second eyelets affixed to said bottom panel; and (q) a plurality of second cord locks securing a section of said second cord lengths at a predetermined position, with said locks, eyelets, sleeves and cord lengths affixed at points as to allow said third compartments to expand and compress to a predetermined volume.

17. The portfolio in claim 16 further combining an upper storage pocket integrally formed with an exterior surface of said second compartment.

18. The portfolio in claim 16 further combining (a) a lower storage pocket formed by said floor panel and said second side walls of said second compartment and said second bottom panels of said plurality of third compartments, and (b) a fourth closure mechanism joining said floor panel to said second bottom panel wherein said fourth closure mechanism when opened provides access to the interior of said lower pocket.

19. A portfolio wearable as a backpack for transporting a load of articles in various sizes including large drawing paper pads useable by an artist, said portfolio comprising:

(a) a generally rectangular open top, first compartment having front and rear walls, vertically-extending long side walls joined to the front and rear walls and a lid for closing said open top, the first compartment being adapted to accommodate some articles of said load including said pads;

(b) shoulder and waist straps attached to the rear wall of the first compartment for mounting the portfolio on the back of the wearer; and (c) a second compartment flanked on either side by third compartments attached to the front wall of the first compartment adapted to accommodate the remaining articles of said load; said second compartment and said third compartments each including compartment expansion means to accommodate the articles loaded therein.

* * * * *